US009842526B2

(12) United States Patent
Kang

(10) Patent No.: US 9,842,526 B2
(45) Date of Patent: Dec. 12, 2017

(54) FLAT PANEL DISPLAY AND DRIVING METHOD THEREOF

(71) Applicant: SAMSUNG DISPLAY CO., LTD., Yongin, Gyeonggi-Do (KR)

(72) Inventor: Byeong-Doo Kang, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 153 days.

(21) Appl. No.: 14/499,710

(22) Filed: Sep. 29, 2014

(65) Prior Publication Data

US 2015/0097823 A1 Apr. 9, 2015

(30) Foreign Application Priority Data

Oct. 8, 2013 (KR) ..... 10-2013-0119676

(51) Int. Cl.

| | |
|---|---|
| ***G09G 3/30*** | (2006.01) |
| ***G09G 5/00*** | (2006.01) |
| ***G09G 3/20*** | (2006.01) |
| *G09G 3/3275* | (2016.01) |
| *G09G 3/36* | (2006.01) |

(52) U.S. Cl.

CPC ..... *G09G 3/20* (2013.01); *G09G 3/3275* (2013.01); *G09G 3/3685* (2013.01); *G09G 2310/0243* (2013.01); *G09G 2310/0248* (2013.01); *G09G 2310/0275* (2013.01); *G09G 2310/0291* (2013.01); *G09G 2310/066* (2013.01); *G09G 2330/025* (2013.01)

(58) Field of Classification Search

CPC ..... G09G 3/30

See application file for complete search history.

(56) References Cited

U.S. PATENT DOCUMENTS

| | | | | |
|---|---|---|---|---|
| 2006/0125759 | A1 | 6/2006 | An | |
| 2007/0035340 | A1* | 2/2007 | Kimura | G09G 3/325 327/524 |
| 2008/0122516 | A1* | 5/2008 | Park | G09G 3/3611 327/333 |
| 2012/0194224 | A1 | 8/2012 | Moon et al. | |
| 2013/0194245 | A1* | 8/2013 | Ryu | G09G 3/3275 345/211 |

FOREIGN PATENT DOCUMENTS

| | | |
|---|---|---|
| KR | 10-2006-0064941 | 6/2006 |
| KR | 10-2008-0012051 | 2/2008 |
| KR | 10-2012-0087440 | 8/2012 |
| KR | 10-2013-0011173 A | 1/2013 |
| KR | 10-1219439 B1 | 1/2013 |

* cited by examiner

*Primary Examiner* — Jennifer Mehmood
*Assistant Examiner* — Carl Adams
(74) *Attorney, Agent, or Firm* — Lee & Morse P.C.

(57) ABSTRACT

A flat panel display includes a signal generator to generate data signals to respective data lines via an output terminal or to generate a control signal for controlling switches. The signal generator includes a first voltage supply unit to supply, to the output terminal, a voltage of a first voltage sources, a voltage stabilizing unit to raise or drop the voltage supplied to the output terminal, and a second voltage supply unit to supply, to the output terminal, a voltage from a second voltage source, after the voltage of the output terminal is raised or dropped.

22 Claims, 3 Drawing Sheets

FLAT PANEL DISPLAY AND DRIVING METHOD THEREOF

CROSS-REFERENCE TO RELATED APPLICATION

Korean Patent Application No. 10-2013-0119676, filed on Oct. 8, 2013, and entitled, "FLAT PANEL DISPLAY AND DRIVING METHOD THEREOF," is incorporated by reference herein in its entirety.

BACKGROUND

1. Field

One or more embodiments described herein relate to a display device.

2. Description of the Related Art

A variety of flat panel displays have been developed. Examples include liquid crystal displays, organic light emitting displays, and plasma display panels. These panels are of interest because of their size, weight, and low power consumption.

SUMMARY

In accordance with one embodiment, a flat panel display including a plurality of pixels respectively positioned in areas divided by scan lines and data lines; and a signal generator configured to generate data signals supplied to respective data lines via an output terminal or a control signal for controlling switches, the signal generator including a first voltage supply unit configured to supply, to the output terminal, a voltage from one of a plurality of first voltage sources; a voltage stabilizing unit configured to raise or drop the voltage supplied to the output terminal; and a second voltage supply unit configured to supply, to the output terminal, a voltage from one of a plurality of second voltage sources, after the voltage of the output terminal is raised or dropped.

The voltage stabilizing unit may raise or drop the voltage supplied to the output terminal based on a voltage of one of the first voltage sources.

The display may include a first switch and a second switch coupled to each data line, wherein the first and second switches are to be alternately turned on and off based on the control signal. The first switch may be a PMOS transistor and the second switch may be an NMOS transistor.

The first voltage supply unit may include a first transistor coupled between a first high voltage source and the output terminal; and a second transistor coupled between a first low voltage source and the output terminal, the second transistor having a turn-on period which does not overlap a turn-on period of the first transistor.

The second voltage supply unit may include a third transistor coupled between a second high voltage source and the output terminal, the third transistor to be turned on after the first transistor is changed from a turned on state to a turned off state; and a fourth transistor coupled between a second low voltage source and the output terminal, the fourth transistor to be turned on after the second transistor is changed from the turned on state to the turned off state.

The second high voltage source may be set to a voltage lower than that of the first high voltage source. The second low voltage source may be set to a voltage higher than that of the first low voltage source.

The voltage stabilizing unit may include a first resistor and a fifth transistor coupled in series between the first high voltage source and the output terminal; and a second resistor and a sixth transistor coupled in series between the first low voltage source and the output terminal. The sixth transistor may turn on during a partial period before the third transistor is turned on, after the first transistor is turned off. The sixth transistor may turn on during a period shorter than a period during which the first transistor is turned on.

The fifth transistor may turn on during a partial period before the fourth transistor is turned on, after the second transistor is turned off. The fifth transistor may turn on during a period shorter than a period during which the second transistor is turned on.

In accordance with another embodiment, a method of driving a flat panel display includes supplying a first high voltage or a first low voltage as a pre-emphasis voltage to an output terminal, to generate a data signal or a control signal for controlling switches; raising or dropping a voltage of the output terminal based on the first high voltage or first low voltage; and supplying a second high voltage or second low voltage to the output terminal.

Dropping the voltage may include dropping the voltage of the output terminal based on the first low voltage after the first high voltage is supplied. The second high voltage may be supplied to the output terminal after the voltage of the output terminal drops and second high voltage may be set to a voltage lower than the first high voltage.

Raising the voltage of the output terminal may include raising the voltage of the output terminal based on the first high voltage after the first low voltage is supplied. The second low voltage may be supplied to the output terminal after the voltage of the output terminal is raised, and the second low voltage may be set to a voltage higher than the first low voltage.

In accordance with another embodiment, a controller for a display device includes a first voltage supply to supply to a first voltage to an output terminal coupled to a data line of the display device; a voltage stabilizer to change the first voltage at the output terminal to a second voltage; and a second voltage supply to supply a third voltage which to the output terminal, after the output terminal voltage is changed to the second voltage, wherein the first voltage is based on a first voltage source and the third voltage is based on a second voltage source different from the first voltage source. The second voltage may be substantially equal to the third voltage.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
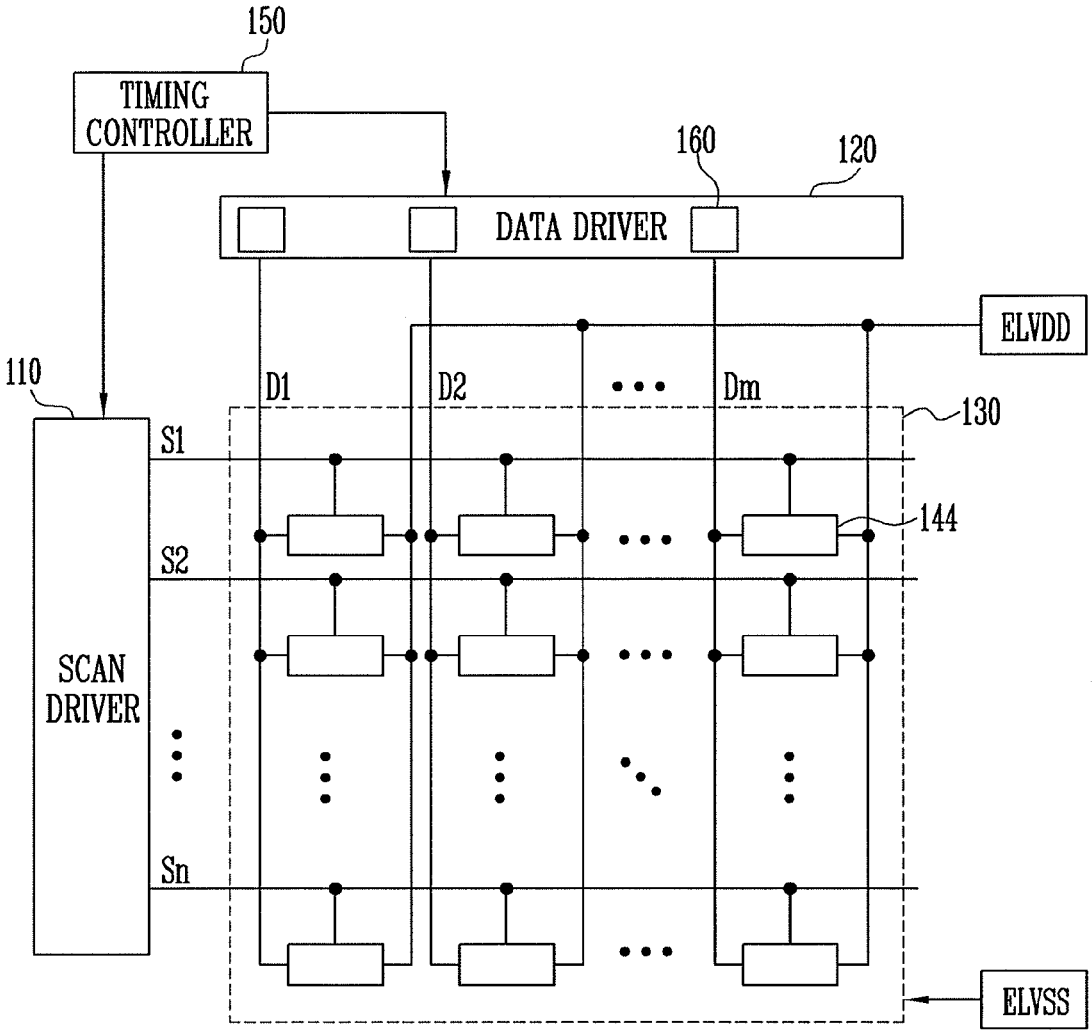
FIG. 1 illustrates an embodiment of an organic light emitting display.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of an organic light emitting display which includes a scan driver 110, a data driver 120, a pixel unit 130, and a timing controller 150. The scan driver 110 drives scan lines S1 to Sn. The data driver 120 drives data lines D1 to Dm. The pixel unit 130 includes pixels 144 respectively positioned in areas defined by scan lines S1 to Sn and data lines D1 to Dm. The timing controller 150 controls the scan driver 110 and data driver 120.

The timing controller 150 controls the scan driver 110 and data driver 120. The timing controller 150 realigns data supplied from an external source and supplies the realigned data to data driver 120.

The scan driver 110 supplies a scan signal to scan lines S1 to Sn. For example, scan driver 110 may progressively supply a scan signal to scan lines S1 to Sn. When the scan signal is progressively supplied to scan lines S1 to Sn, pixels 144 are sequentially selected for each horizontal line.

The data driver 120 supplies data signals to respective ones of data lines D1 to Dm. The data driver 120 supplies a first data signal to cause pixel 144 to emit light, or a second data signal to cause the pixel 144 to not emit light, in accordance with a digital driving method. For example, data driver 120 supplies data signals corresponding to emission or non-emission states of pixel 144.

The data driver 120 includes a signal generator 160 for each of a plurality of channels. The signal generator 160 supplies a pre-emphasis voltage, and supplies a voltage lower or higher than the pre-emphasis voltage. For example, signal generator 160 supplies a pre-emphasis voltage, and supplies a voltage lower or higher than the pre-emphasis voltage, to thereby stabilize voltages of data lines D1 to Dm.

Subsequently, signal generator 140 supplies, to data lines D1 to Dm, a voltage corresponding to the first or second data signal. In this case, the voltage of a desired data signal may be supplied to pixels 144 by the pre-emphasis voltage. Accordingly, it is possible to improve display quality.

The pixel unit 130 receives first and second power sources ELVDD and ELVSS from one or more external sources, and supplies the first and second power sources ELVDD and ELVSS to each pixel 144. Each pixel 144 emits light at a gray scale value based on current supplied to an organic light emitting diode (emission), based on a data signal. Each pixel 144 does not emit light when current is not supplied to the organic light emitting diode (non-emission), corresponding to a data signal. Additionally, pixel 144 may be implemented by various types of circuits corresponding to the digital driving method.

Figure 2:
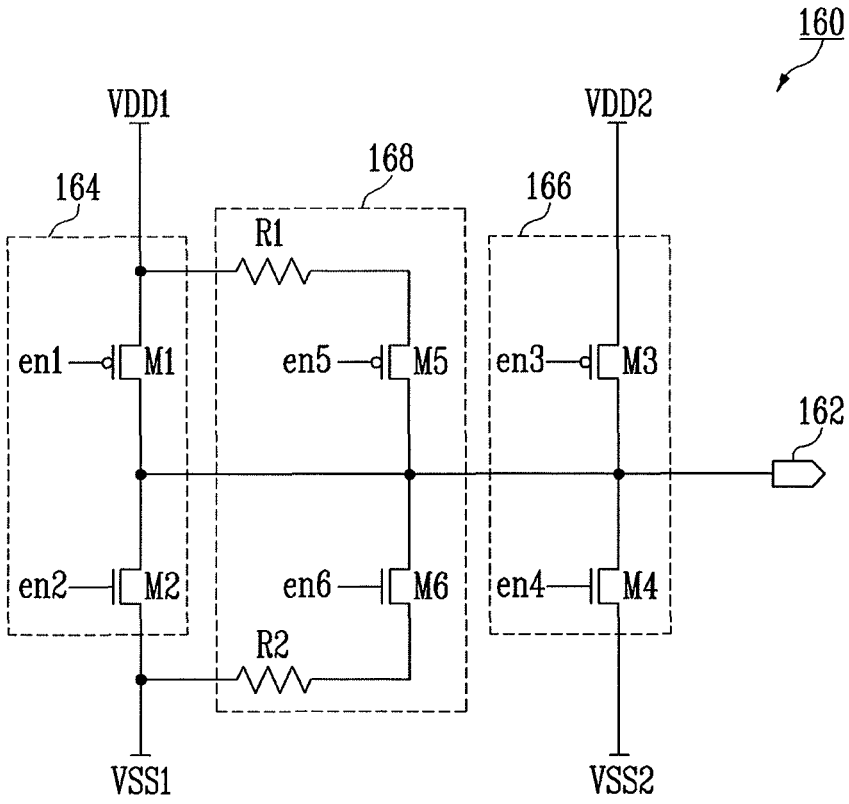
FIG. 2 illustrates an embodiment of a signal generator.

FIG. 2 illustrates an embodiment of a signal generator 160 which includes a first voltage supply unit 164 to supply voltage of a first voltage source VDD1 or VSS1 as a pre-emphasis voltage, a second voltage supply unit 166 to supply voltage of a second voltage source VDD2 or VSS2 higher or lower than the pre-emphasis voltage, and a voltage stabilizing unit 168 to raise or drop a voltage of an output terminal 162 after the pre-emphasis voltage is supplied.

The first voltage supply unit 164 supplies, as the pre-emphasis voltage, the voltage of a first high voltage source VDD1 or the voltage of a first low voltage source VSS1. The first voltage supply unit 164 includes a first transistor M1 coupled between first high voltage source VDD1 and output terminal 162, and a second transistor M2 coupled between first low voltage source VSS1 and output terminal 162.

The first high voltage source VDD1 may be set to a high voltage used as the pre-emphasis voltage, e.g., a positive voltage. The first low voltage source VSS1 may be set to a low voltage used as the pre-emphasis voltage, e.g., a negative voltage.

The first transistor M1 is turned on based on a first enable signal en1. When first transistor M1 turns on, the voltage of the first high voltage source VDD1 is supplied to output terminal 162. The first transistor M1 that supplies the voltage of the first high voltage source VDD1 is a PMOS transistor, which stably turns on when the first enable signal en1 is set to a low voltage.

The second transistor M2 is turned on based on a second enable signal en2. When second transistor M2 turns on, the voltage of first low voltage source VSS1 is supplied to output terminal 162. The second transistor M2 supplying the voltage of the first low voltage source VSS1 is an NMOS transistor, which stably turns on when second enable signal en2 is set to a high voltage.

The second voltage supply unit 166 supplies the voltage of a second high voltage source VDD2 or the voltage of a second low voltage source VSS2. The second voltage supply unit 166 includes a third transistor M3 coupled between second high voltage source VDD2 and output terminal 162, and a fourth transistor M4 coupled between second low voltage source VSS2 and output terminal 162.

The second high voltage source VDD2 is set to a voltage lower than that of the first high voltage source VDD1. For example, the voltage of the second high voltage source VDD2 is supplied to output terminal 162 after the voltage of first high voltage source VDD1 is supplied as the pre-emphasis voltage. Here, the voltage of the second high voltage source VDD2 is supplied as the second data signal (or first data signal) to a data line (any one of D1 to Dm).

The second low voltage source VSS2 is set to a voltage higher than that of the first low voltage source VSS1. For example, the voltage of the second low voltage source VSS2 is supplied to output terminal 162 after the voltage of the first low voltage source VSS1 is supplied as the pre-emphasis voltage. Here, the voltage of the second low voltage source VSS2 is supplied as the first data signal (or second data signal) to a data line (any one of D1 to Dm).

The third transistor M3 is turned on based on a third enable signal en3. When third transistor M3 turns on, the voltage of the second high voltage source VDD2 is supplied to output terminal 162. The third transistor M3 is a PMOS transistor, which stably turns when the third enable signal en3 is set to a low voltage.

The fourth transistor M4 is turned on based on a fourth enable signal en4. When the fourth transistor M4 turns on, the voltage of the second low voltage source VSS2 is supplied to output terminal 162. The fourth transistor M4 is an NMOS transistor, which stably turns when the fourth enable signal en4 is set to a high voltage.

The voltage stabilizing unit 168 raises or drops the voltage of output terminal 162, before the voltage is supplied from the second voltage supply unit 16 to output terminal 162 and after the voltage is supplied from first voltage supply unit 164 to output terminal 162. The voltage stabilizing unit 168 may raise or drop the voltage of output terminal 162 using first high voltage source VDD1 or first low voltage source VSS1.

In one embodiment, voltage stabilizing unit 168 includes a first resistor R1 and a fifth transistor M5 coupled in series between the first high voltage source VDD1 and output terminal 162. The voltage stabilizing unit 168 further includes second resistor R2 and a sixth transistor M6 coupled in series between the first low voltage source VSS1 and output terminal 162.

The fifth transistor M5 is turned on based on a fifth enable signal en5. When fifth transistor M5 turns on, the voltage of the first high voltage source VDD1 is supplied to output terminal 162. The first resistor R1 is coupled between the first high voltage source VDD1 and fifth transistor M5, and serves to limit the amount of current flowing from first high voltage source VDD1 to output terminal 152. The fifth transistor M5 is a PMOS transistor, and the fifth enable signal en5 is set to a low voltage to turn on this transistor.

The sixth transistor M6 is turned on based on a sixth enable signal en6. When sixth transistor M6 is turned on, the voltage of the first low voltage source VSS1 is supplied to output terminal 162. The second resistor R2 is coupled between the first low voltage source VSS1 and sixth transistor M6, and serves to limit the amount of current flowing from output terminal 162 to first low voltage source VSS1. The sixth transistor M6 is an NMOS transistor, and the sixth enable signal en6 is set to a high voltage to turn on the sixth transistor M6.

Figure 3:
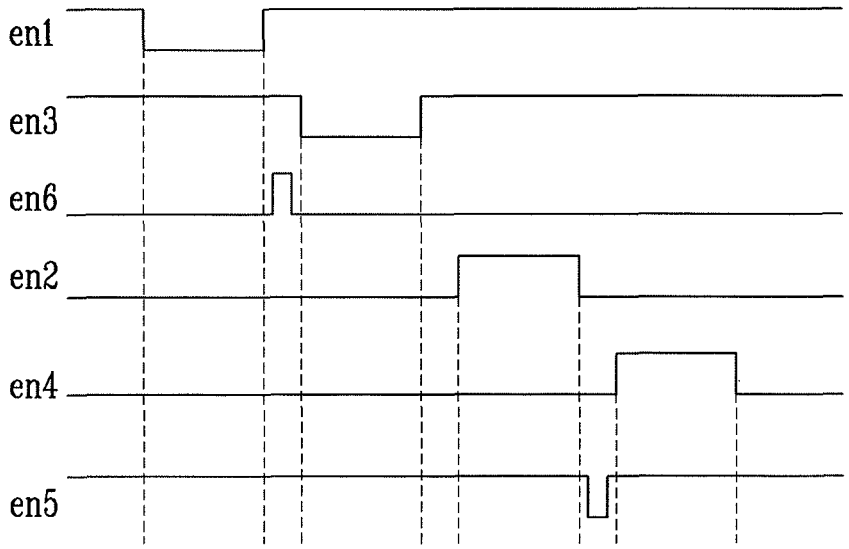
FIG. 3 illustrates an embodiment of an operating process for the signal generator.

FIG. 3 illustrating a embodiment of a process for operating the signal generator in FIG. 2. Referring to FIG. 3, the first enable signal en1 is first supplied to turn on first transistor M1. When first transistor M1 turns on, the voltage of the first high voltage source VDD1 is supplied as a pre-emphasis voltage to the output terminal 162.

After the voltage of first high voltage source VDD1 is supplied to output terminal 162, the sixth enable signal en6 is supplied to turn on sixth transistor M6. When sixth transistor M6 turns on, the voltage of first low voltage source VSS1 is supplied to output terminal 162 via second resistor R2. In this case, current flows from output terminal 162 to first low voltage source VSS1. Thus, the amount of current flowing from output terminal 162 to first low voltage source VSS is limited by the second resistor R2. Accordingly, the voltage of output terminal 162 gradually drops from the voltage of the first high voltage source VDD1.

In the present embodiment, the turn-on period of sixth transistor M6 is set to be shorter than that of first transistor M1. For example, the turn-on period of sixth transistor M6 may be experimentally determined, so that the voltage of the output terminal 162 drops approximately to the voltage of second high voltage source VDD2.

After the voltage of output terminal 162 drops from the voltage of the first high voltage source VDD1 to a predetermined voltage (e.g., the voltage of second high voltage source VDD2), the third enable signal en3 is supplied to turn on third transistor M3. When third transistor M3 turns on, the voltage of the second high voltage source VDD2 is supplied to output terminal 162.

In the present embodiment, the voltage of the first high voltage source VDD1 is supplied as a pre-emphasis voltage to output terminal 162. As a result, a desired voltage of the second data signal (or first data signal) may be supplied to pixel 144, via a data line (any one of D1 to Dm), regardless of its forming position.

In the present embodiment, the voltage of output terminal 162 drops using the voltage of first low voltage source VSS1, after the voltage of first high voltage source VDD1 is supplied. The voltage of second high voltage source VDD2 is supplied after the voltage of output terminal 162 drops. In this case, the voltage of first high voltage source VDD1 is not supplied to second high voltage source VDD2 when third transistor M3 is turned on. Accordingly, it is possible to ensure the driving stability.

The aforementioned description corresponds to the case where the second data signal (or first data signal) is supplied to data line D1 to Dm. In a case where the first data signal (or second data signal) is supplied to data line D1 to Dm, signal generator 160 may be driven in the following manner.

First, the second enable signal en2 is supplied so that the second transistor M2 is turned on. If the second transistor M2 is turned on, the voltage of the first low voltage source VSS1 is supplied as the pre-emphasis voltage to the output terminal 162.

After the voltage of first low voltage source VSS1 is supplied to output terminal 162, the fifth enable signal en5 is supplied to turn on fifth transistor M5. When the fifth transistor M5 turns on, the voltage of the first high voltage source VDD1 is supplied to output terminal 162 via first resistor R1. In this case, current flows from first high voltage source VDD1 to output terminal 162. Thus, the amount of current flowing from first high voltage source VDD1 to output terminal 162 is limited. Accordingly, the voltage of output terminal 162 gradually rises from the voltage of the first low voltage source VSS1.

The turn-on period of the fifth transistor M5 may be set shorter than that of the second transistor M2. For example, the turn-on period of fifth transistor M5 may be experimentally determined, so that the voltage of output terminal 162 is raised approximately to the voltage of the second low voltage source VSS2.

After the voltage of output terminal 162 is raised from the voltage of the first low voltage source VSS1 to a predetermined voltage (e.g., the voltage of second low voltage source VSS2), the fourth enable signal en4 is supplied to turn on fourth transistor M4. When fourth transistor M4 turns on, the voltage of second low voltage source VSS2 is supplied to output terminal 162.

In the present embodiment, the voltage of the first low voltage source VSS1 is supplied as the pre-emphasis voltage to output terminal 162. As a result, a desired voltage of the first data signal (or second data signal) may be supplied to pixel 144, via a data line (any one of D1 to Dm), regardless of its forming position. In the present embodiment, the voltage of output terminal 162 is raised after the voltage of the first low voltage source VSS1 is supplied. The voltage of the second low voltage source VSS2 is supplied after the voltage of output terminal 162 is raised. In this case, the voltage of first low voltage source VSS1 is not supplied to second low voltage source VSS2 when fourth transistor M4 turns on. Accordingly, it is possible to ensure the stability of driving.

In this embodiment, signal generator 160 is used in an organic light emitting display. In another embodiment, signal generator 160 may be included in a liquid crystal display driven by a digital driving method. In addition, the signal of signal generator 160 may be used as a control signal for one or more switches in the panel.

Figure 4:
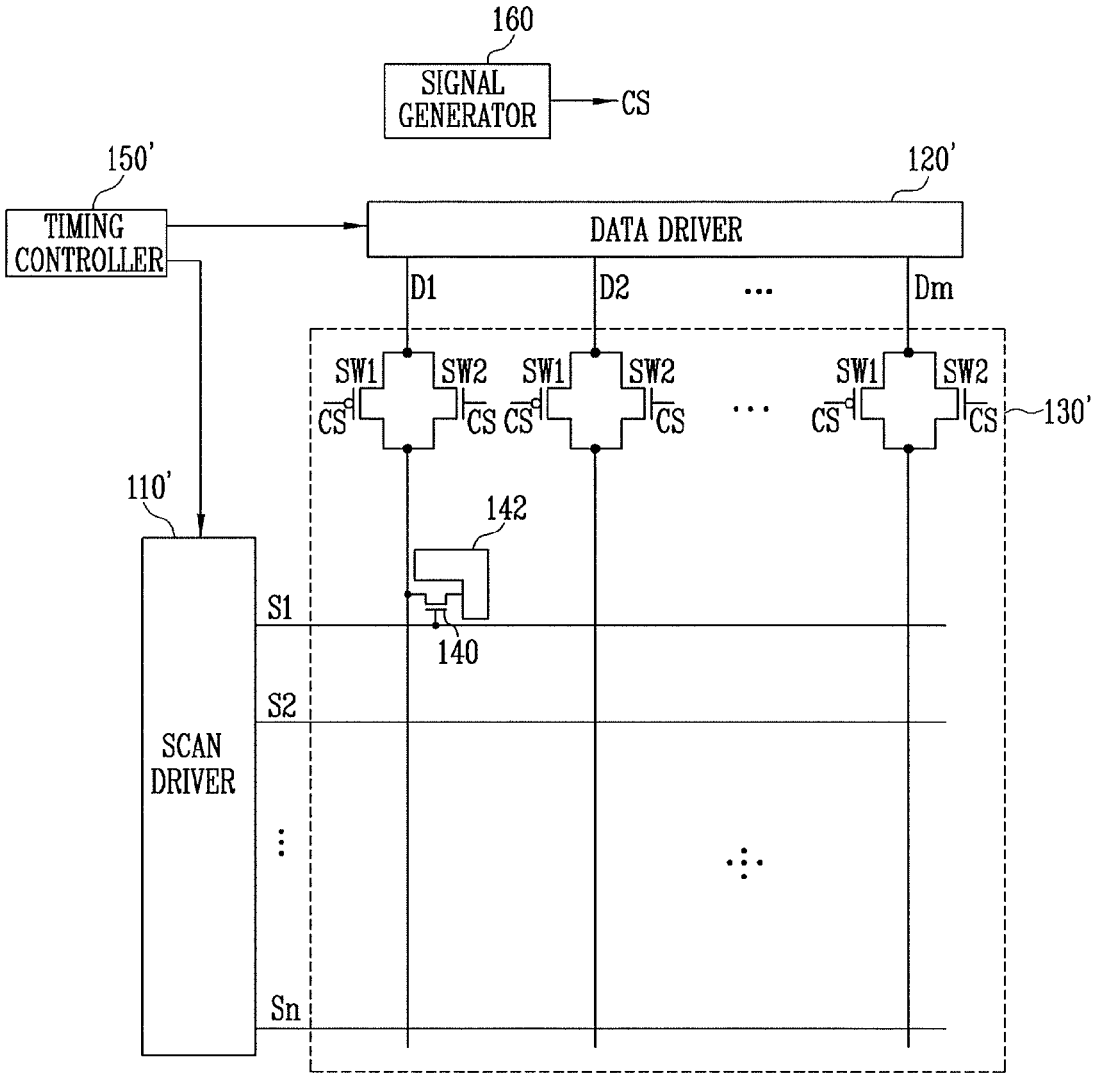
FIG. 4 is a diagram illustrating an embodiment of a liquid crystal display.

FIG. 4 illustrates an embodiment of a liquid crystal display which includes a data driver 120', a liquid crystal panel 130', and a timing controller 150'. The liquid crystal panel 130' includes pixels in areas divided by data lines D1 to Dm and scan lines S1 to Sn. The data driver 120' drives data lines D1 to Dm. A scan driver 110' drives scan lines S1 to Sn. The timing controller 150 controls scan driver 110' and data driver 120'.

The liquid crystal display further includes first and second switches SW1 and SW2 coupled to each data line D1 to Dm, and a signal generator 160 to supply a control signal to the first and second switches SW1 and SW2.

Although signal generator 160 and data driver 120' are separated from each other in FIG. 4, signal generator 160 may be positioned in data driver 120' or timing controller 150' in another embodiment. Also, a plurality of first switches SW1 and a plurality of second switches SW2 may be coupled to each data line D1 to Dm to be driven in the form of a demultiplexer (DEMUX). However, in the present embodiment, for convenience of illustration, one first switch SW1 and one second switch SW are illustrated to be coupled to each data line D1 to Dm.

The scan driver 110' supplies a scan signal to scan lines S1 to Sn. For example, scan driver 110' progressively supplies a scan signal to scan lines S1 to Sn. If the scan signal is progressively supplied to scan lines S1 to Sn, thin film transistors 140 in respective pixels turn on in each horizontal line.

The data driver 120' generates data signals for input into data lines D1 to Dm for each horizontal period in which the scan signal is supplied. In this case, data signals supplied to data lines D1 to Dm are supplied to pixels via first and second switches SW1 and SW2.

The liquid crystal panel 130' includes pixels respectively positioned at intersection portions of scan lines S1 to Sn and data lines D1 to Dm.

Each pixel includes a thin film transistor 140 and a pixel electrode 142. The thin film transistor 140 supplies the data signal from a data line (any one of D1 to Dm) to the pixel electrode 142, in response to the scan signal from a scan line (any one of S1 to Sn). The pixel electrode 142 drives liquid crystals between the pixel electrode 142 and a common electrode in response to a data signal, thereby controlling the transmittance of light.

The timing controller 150' controls the scan driver 110' and data driver 120'.

The first and second switches SW1 and SW2 are formed in liquid crystal panel 130' and are coupled to each of the data lines D1 to Dm. That is, the first and second switches SW1 and SW2 are coupled in parallel to each of the data lines D1 to Dm between the pixels. The first and second switches SW1 and SW2 supply data signals from data lines D1 to Dm to the pixels, while being alternately turned on and off based on control signal CS. For example, first and second switches SW1 and SW2 may supply a positive or negative data signal to the pixels, while being alternately turned on and off for each horizontal period, corresponding to an inversion driving method.

The first and second switches SW1 and SW2 may be by different conductive-type transistors so that they may be alternately turned on and off based on the control signal. For example, first switch SW1 may be a PMOS transistor and second switch SW2 may be an NMOS transistor.

The signal generator 160 generates control signal CS, and supplies the control signal CS to first and second switches SW1 and SW2. The signal generator 160 supplies a pre-emphasis voltage during an initial period of the horizontal period, and supplies a voltage higher or lower than the pre-emphasis voltage so that the first or second switch SW1 or SW2 stably turns on. The configuration and operating process of signal generator 160 are identical to those in FIGS. 2 and 3. However, in signal generator 160, first switch SW1 may be turned on when a second low voltage VSS2 is supplied as the control signal CS, and the second switch SW2 may be turned on when a second high voltage VDD2 is supplied.

By way of summation and review, a flat panel display generally includes pixels respectively positioned at intersection portions of scan lines and data lines, a scan driver to drive the scan lines, and a data driver to drive the data lines.

The scan driver selects pixels for each line, while progressively supplying a scan signal to the scan lines. The data driver supplies data signals to the data lines synchronized with the scan signal. In this case, the pixels selected by the scan signal charge a voltage corresponding ones of the data signals. The pixels display an image with a predetermined luminance based on the data signals.

The flat panel display supplies data signals or controls switches in a panel using a pre-emphasis voltage. However, when a voltage lower or higher than the pre-emphasis voltage is supplied after the pre-emphasis voltage is supplied, a power unit (DC-DC converter) is not normally driven. For example, over-voltage protection of a power unit may be operated by a sudden change in voltage. As a result, a desired voltage may not be generated in the power unit.

In accordance with one or more of the aforementioned embodiments, after a voltage of the first high voltage source or first low voltage source is supplied as a pre-emphasis voltage, the voltage of the output terminal is raised or dropped based on the voltage of the first low voltage source or the voltage of the first high voltage source. Subsequently, the voltage of the second high voltage source or the voltage of the second low voltage source is supplied to the output terminal. As a result, a power unit may be prevented from being erroneously operated by a high (or low) voltage, thereby ensuring driving stability.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless specifically indicated. Accordingly, it will be understood by those of skill in the art that various changes in form and details may be made without departing from the spirit and scope of the present invention as set forth in the following claims.

What is claimed is:

1. A flat panel display, comprising:

a plurality of pixels respectively positioned in areas divided by scan lines and data lines; and a signal generator to generate data signals supplied to respective data lines via an output terminal or a control signal for controlling switches, wherein the signal generator includes:

a first voltage supply to supply, to the output terminal, a voltage using one of first high and low voltage sources during a first period such that the data signals are pre-emphasized or the control signal is pre-emphasized;

a voltage stabilizer to raise or drop the voltage supplied to the output terminal using another of the first high and low voltage sources during a second period after the first period such that the pre-emphasized data signals are suppressed or the pre-emphasized control signal is suppressed; and a second voltage supply to supply, to the output terminal, a voltage using one of second high and low voltage sources during a third period after the second period, after the voltage of the output terminal is raised or dropped.

2. The display as claimed in claim 1, wherein the first period, the second period, and the third period are separated from each other with gaps.

3. The flat panel display as claimed in claim 1, further comprising:

a first switch and a second switch being between a data driver and a pixel and being coupled to each data line, the first and second switches to control an electrical connection between the data driver and the pixel, wherein the first and second switches are to be alternately turned on and off based on the control signal.

4. The display as claimed in claim 3, wherein:

the first switch is a PMOS transistor, and the second switch is an NMOS transistor.

5. The display as claimed in claim 1, wherein the first voltage supply includes:

a first transistor coupled between the first high voltage source and the output terminal; and a second transistor coupled between the first low voltage source and the output terminal, the second transistor having a turn-on period which does not overlap a turn-on period of the first transistor.

6. The display as claimed in claim 5, wherein the second voltage supply includes:

a third transistor coupled between the second high voltage source and the output terminal, the third transistor to be turned on after the first transistor is changed from a turned on state to a turned off state; and a fourth transistor coupled between the second low voltage source and the output terminal, the fourth transistor to be turned on after the second transistor is changed from the turned on state to the turned off state.

7. The display as claimed in claim 6, wherein the second high voltage source is set to a voltage lower than that of the first high voltage source.

8. The display as claimed in claim 6, wherein the second low voltage source is set to a voltage higher than that of the first low voltage source.

9. The display as claimed in claim 6, wherein the voltage stabilizer includes:

a first resistor and a fifth transistor coupled in series between the first high voltage source and the output terminal; and a second resistor and a sixth transistor coupled in series between the first low voltage source and the output terminal.

10. The display as claimed in claim 9, wherein the sixth transistor is turned on during a partial period before the third transistor is turned on, after the first transistor is turned off.

11. The display as claimed in claim 9, wherein the sixth transistor is turned on during a period shorter than a period during which the first transistor is turned on.

12. The display as claimed in claim 9, wherein the fifth transistor is turned on during a partial period before the fourth transistor is turned on, after the second transistor is turned off.

13. The display as claimed in claim 9, wherein the fifth transistor is turned on during a period shorter than a period during which the second transistor is turned on.

14. The display as claimed in claim 1, wherein a width of the second period is determined based on a voltage difference between the one of the first high and low voltage sources and the one of the second high and low voltage sources.

15. The display as claimed in claim 1, wherein the first voltage supply, the voltage stabilizer, and the second voltage supply are commonly connected to the output terminal.

16. A method of driving a flat panel display, the method comprising:

supplying one of first high and low voltages to an output terminal during a first period, to pre-emphasize a data signal or a control signal for controlling switches;

raising or dropping the pre-emphasized data signal or control signal using another of the first high and low voltages during a second period after the first period such that the pre-emphasized data signal or control signal is suppressed; and supplying one of second high and low voltages to the output terminal during a third period after the second period.

17. The method as claimed in claim 16, wherein dropping the pre-emphasized data signal or control signal includes dropping the voltage of the output terminal based on the first low voltage after the first high voltage is supplied to the output terminal during the first period.

18. The method as claimed in claim 17, wherein:

the second high voltage is supplied to the output terminal after the pre-emphasized data signal or control signal is dropped and the second high voltage is set to a voltage lower than the first high voltage.

19. The method as claimed in claim 16, wherein raising the pre-emphasized data signal or control signal includes raising the pre-emphasized data signal or control signal based on the first high voltage after the first low voltage is supplied to the output terminal during the first period.

20. The method as claimed in claim 19, wherein:

the second low voltage is supplied to the output terminal after the pre-emphasized data signal or control signal is raised, and the second low voltage is set to a voltage higher than the first low voltage.

21. A controller for a display device, the controller comprising:

a first voltage supply to supply one of first high and low voltage sources to an output terminal coupled to a data line of the display device during a first period such that a data signal supplied to the data line is pre-emphasized;

a voltage stabilizer to suppress the pre-emphasized data signal at the output terminal using another of the first high and low voltage sources during a second period after the first period such that the pre-emphasized data signal is suppressed; and a second voltage supply to supply one of second high and low voltage sources to the output terminal, after the output terminal voltage is suppressed by the voltage stabilizer, during a third period after the second period, wherein the one of the first high and low voltage sources is different from the one of the second high and low voltage sources.

22. The controller as claimed in claim 21, wherein the suppressed pre-emphasized data signal is substantially equal to the one of the second high and low voltage sources.

* * * * *